US005452927A

United States Patent [19]

Uyeda

[11] Patent Number: 5,452,927

[45] Date of Patent: Sep. 26, 1995

[54] DOOR LATCHING AND UNLATCHING ASSEMBLY

[75] Inventor: Alan K. Uyeda, Pico Rivera, Calif.

[73] Assignee: Adams Rite Mfg. Co., Industry, Calif.

[21] Appl. No.: 283,693

[22] Filed: Aug. 1, 1994

[51] Int. Cl.[6] ..... E05C 3/04

[52] U.S. Cl. ..... 292/202; 292/200; 292/196

[58] Field of Search ..... 292/202, 200, 292/199, 196, 197

[56] References Cited

U.S. PATENT DOCUMENTS

| | | | |
|---|---|---|---|
| 1,213,651 | 1/1917 | Johns . | |
| 2,243,772 | 5/1941 | Peltier | 292/11 |
| 2,854,839 | 10/1958 | Eads | 292/200 X |
| 2,993,358 | 7/1961 | Craig | 70/153 |
| 3,011,330 | 12/1961 | Eads | 70/100 |
| 3,011,817 | 12/1961 | Eads | 292/140 |
| 3,103,804 | 9/1963 | Wood et al. | 292/196 X |
| 3,214,947 | 11/1965 | Wikkerink | 70/92 |
| 3,368,374 | 2/1968 | Eads | 70/100 |
| 3,869,159 | 3/1975 | Eads | 292/336.3 |
| 3,899,906 | 8/1975 | Bradstock | 292/200 X |
| 4,003,593 | 1/1977 | Wilzig et al. | 292/165 |
| 4,052,092 | 10/1977 | Bergen | 292/172 |
| 4,127,016 | 11/1978 | Ibsen | 292/800 X |
| 4,218,903 | 8/1980 | Eads | 70/107 |
| 4,387,918 | 6/1983 | Dunphy et al. | 292/199 X |
| 4,458,928 | 7/1984 | Hirschbein | 292/92 |
| 4,604,878 | 8/1986 | Todd et al. | 292/200 X |
| 4,790,583 | 12/1988 | Tonsmann et al. | 292/336.3 |
| 4,982,986 | 1/1991 | Gressett, Jr. et al. | 292/336.3 |

FOREIGN PATENT DOCUMENTS

| | | | |
|---|---|---|---|
| 1300293 | 6/1992 | France | 292/199 |

OTHER PUBLICATIONS

"Handle 4160" Adams Rite Manufacturing Co., #SW-34A, 1984, 2 pages.

"Eurostyle Handle 4567", Adams Rite Manufacturing Co., #SW-34C, 1983, 2 pages.

*Primary Examiner*—Peter M. Cuomo
*Assistant Examiner*—Monica E. Millner
*Attorney, Agent, or Firm*—William W. Haefliger

[57] ABSTRACT

A door latching and unlatching assembly comprising a carrier; a door latching bolt carried by the carrier to rotate between locking and unlocking positions; a door latching operating handle rotatable between open and closed positions; a rotor associated with and rotatable relative to the carrier, and two cams on the rotor and rotatable therewith, the rotor operatively connected with the handle, to be rotated in response to handle rotation; and structure operatively connected with the bolt and located to be displaced by one cam in response to rotation of the rotor in one direction for rotating the bolt to unlocking position, and to be displaced by the other cam in response to rotation of the rotor in the opposite direction for rotating the bolt to door locking position.

13 Claims, 8 Drawing Sheets

FIG. 8.
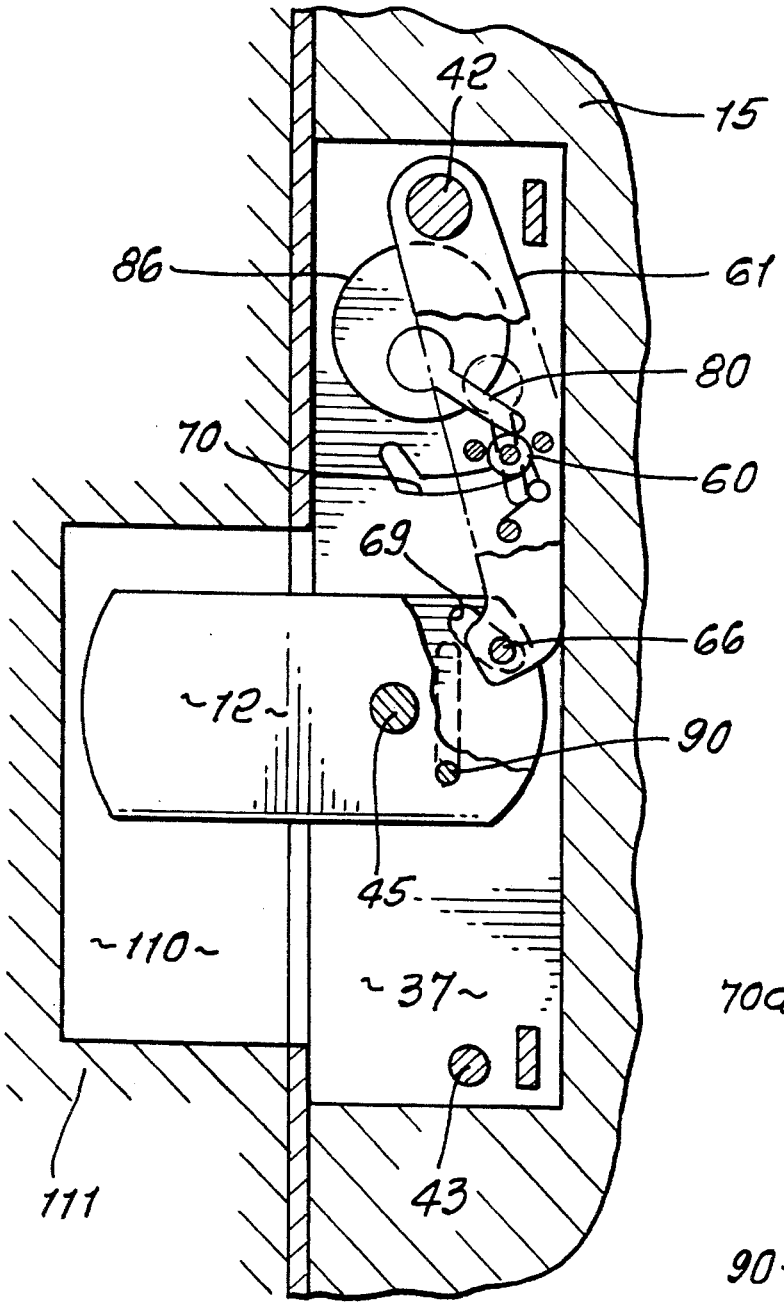
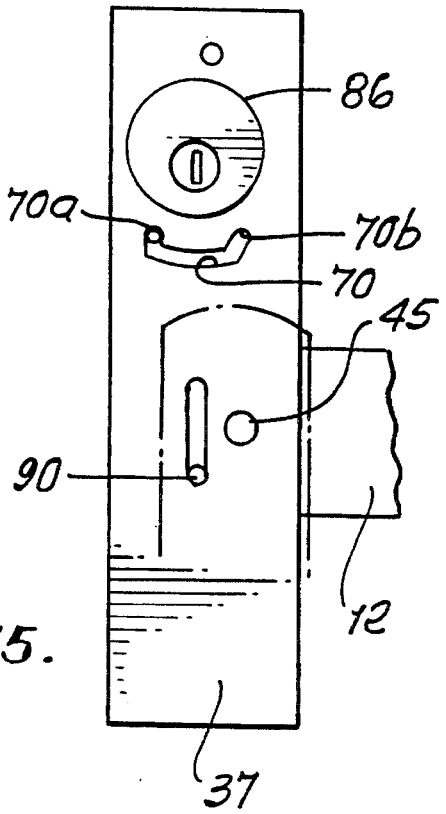
FIG. 15.

FIG. 11.
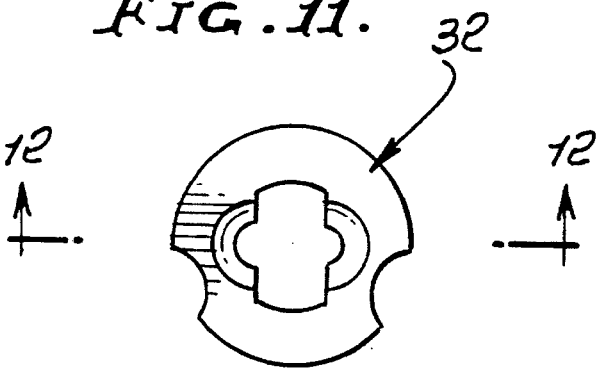
FIG. 12.
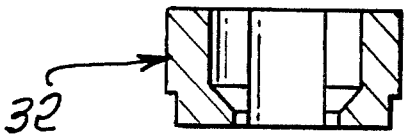
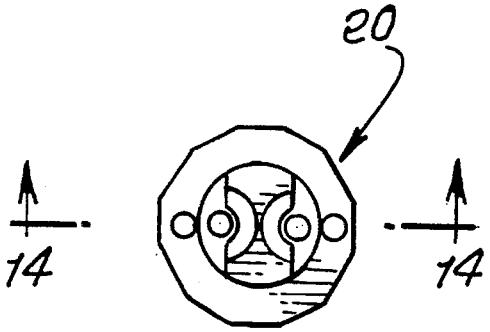
FIG. 13.
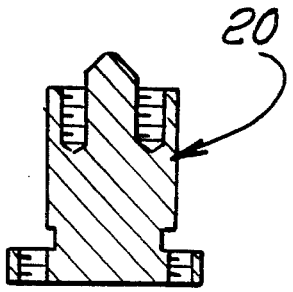
FIG. 14.

DOOR LATCHING AND UNLATCHING ASSEMBLY

BACKGROUND OF THE INVENTION

This invention relates generally to door locking and unlocking apparatus; and more specifically, it concerns the enablement of door opening as by simple movement of a handle effected by a disabled person at the inner side of the door, and as integrated with door opening as by operation of a key in a lock at the opposite side of the door.

There is need for simple, effective apparatus that will enable the above functions, in a simple, reliable manner. Also, there is need for apparatus having the improved construction, mode of operation, and results as herein disclosed.

SUMMARY OF THE INVENTION

It is a major object of the invention to provide improved apparatus meeting the above needs. Basically, the invention incorporates in a door latching and unlatching assembly, the following:

a) a carrier, b) a door latching bolt carried by the carrier to rotate between locking and unlocking positions, c) a door latching operating handle rotatable between open and closed positions, d) a rotor associated with and rotatable relative to the carrier, and two cams on the rotor and rotatable therewith, the rotor operatively connected with the handle, to be rotated in response to handle rotation, e) and structure operatively connected with the bolt and located to be displaced by one cam in response to rotation of the rotor in one direction for rotating the bolt to unlocking position, and to be displaced by the other cam in response to rotation of the rotor in the opposite direction for rotating the bolt to door locking position.

Another object is to provide two such cams, characterized in that one cam has pivoted connection to the rotor, whereby one cam pivots to decouple from the structure upon return rotation of the rotor in the other direction to an initial position after opening of the bolt; and the other cam has pivoted connection to the rotor, whereby the other cam pivots to decouple from the structure upon return rotation of the rotor in one direction to an initial position after closing of the bolt.

A further object is to provide a follower positioned to be displaced in one direction by one cam, and to be displaced by the other cam in the other direction. The structure typically includes a rotatable arm carrying the follower; and the arm may have lost motion connecting to the bolt, allowing the bolt to be rotated only after the arm has been rotated to predetermined extent.

Yet another object is to provide such a follower to have a projection movable in a slot defined by non-rotary structure associated with the carrier, the slot having turned ends acting as keepers for the projection at the extremes of arm rotary excursion. In this regard, such predetermined extent of arm rotation acts to move the projection out of one or the other of the slot turned ends.

An additional object includes the provision of a carrier that includes a housing having an edge to be located proximate an edge of the door, the handle comprising a lever which, in the open and closed positions, is spaced at one side of the housing edge. The lever typically has a neutral position in which the lever extends substantially horizontally to be impacted downwardly, and wherein, in the bolt unlocking position, the lever has been rotated downwardly relative to neutral position. Accordingly, it is very easy for a disabled person to quickly strike the handle downwardly and thereby open the latch, enabling rapid door opening during an emergency, as will be seen.

These and other objects and advantages of the invention, as well as the details of an illustrative embodiment, will be more fully understood from the following specification and drawings, in which:

DRAWING DESCRIPTION

FIG. 8 is taken in elevation on lines 8—8 of FIG. 3 and showing the bolt in latching position;

FIG. 11 is an axial view of a plug extension seen in axial section in FIG. 10;

FIG. 12 is an axial section taken on lines 12—12 of FIG. 11;

FIG. 13 is an axial end view of a plug as is also seen in axial section in FIG. 10;

FIG. 14 is a section taken on lines 14—14 of FIG. 13;

FIG. 15 is an elevation showing a side plate as is also partially seen in FIG. 6;

GENERAL DESCRIPTION

Figure 1:
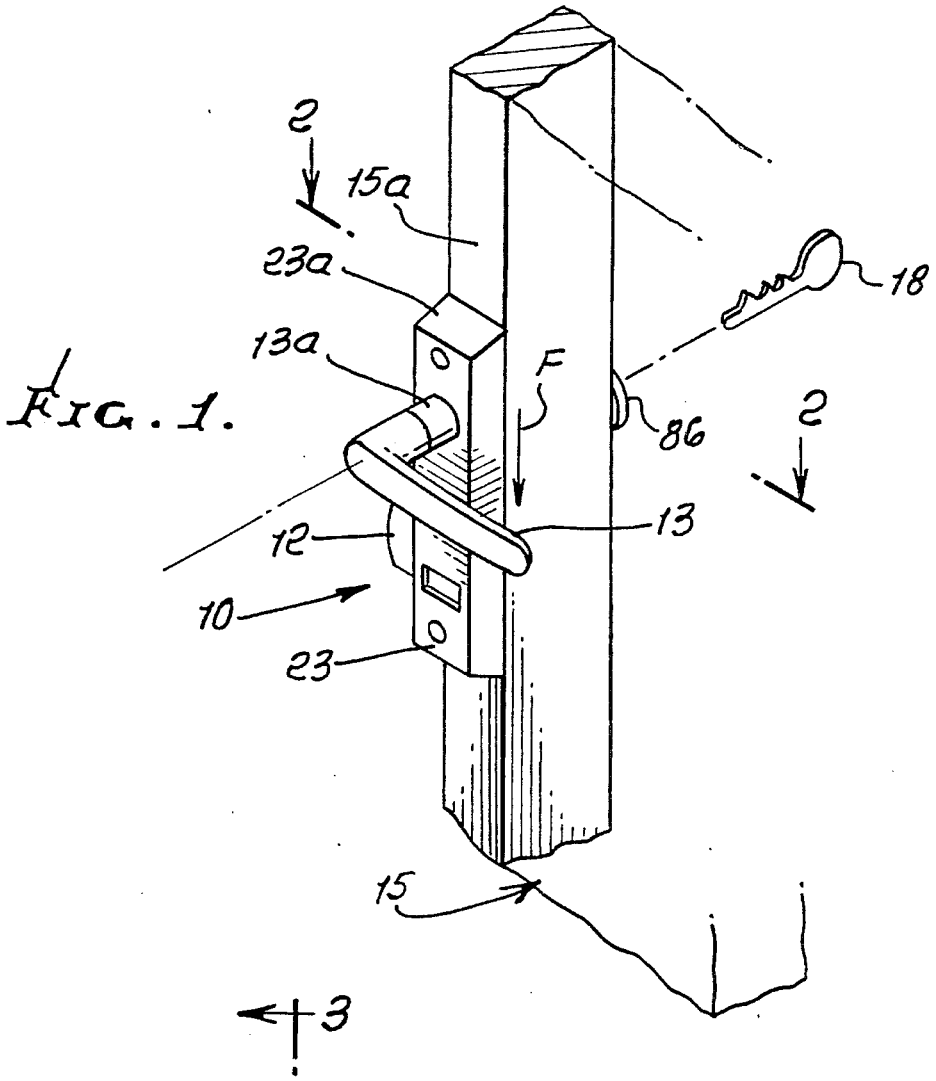
FIG. 1 is a perspective view of apparatus incorporating the invention, as installed on a door.

In the drawings, a door latching and unlatching assembly 10 includes a carrier 11; a latching bolt 12 carried by the carrier to rotate between door locking position (FIGS. 2, 6, and 8) and unlocking position (FIGS. 7 and 9); and a door latching operating handle, of crank type, rotatable between open and closed positions.

Figure 2:
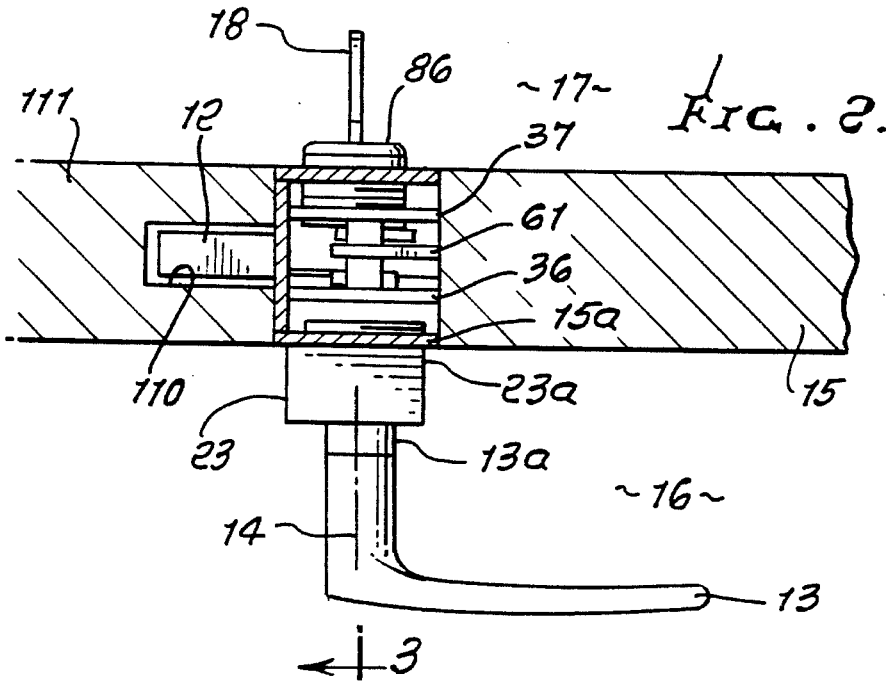
FIG. 2 is a plan view taken in section on lines 2—2 of FIG. 1.

FIGS. 1 and 2 show the handle in the form of a lever 13 extending in closed position, with bolt 12 in latching position. The lever handle is shown to extend horizontally (i.e., in 3 o'clock position) from a shank 13*a* that extends axially in the direction of axis 14 about which the lever handle is rotatable clockwise downwardly, i.e., toward 6 o'clock position, at which time the bolt is pivotally retracted to FIG.

Figure 9:
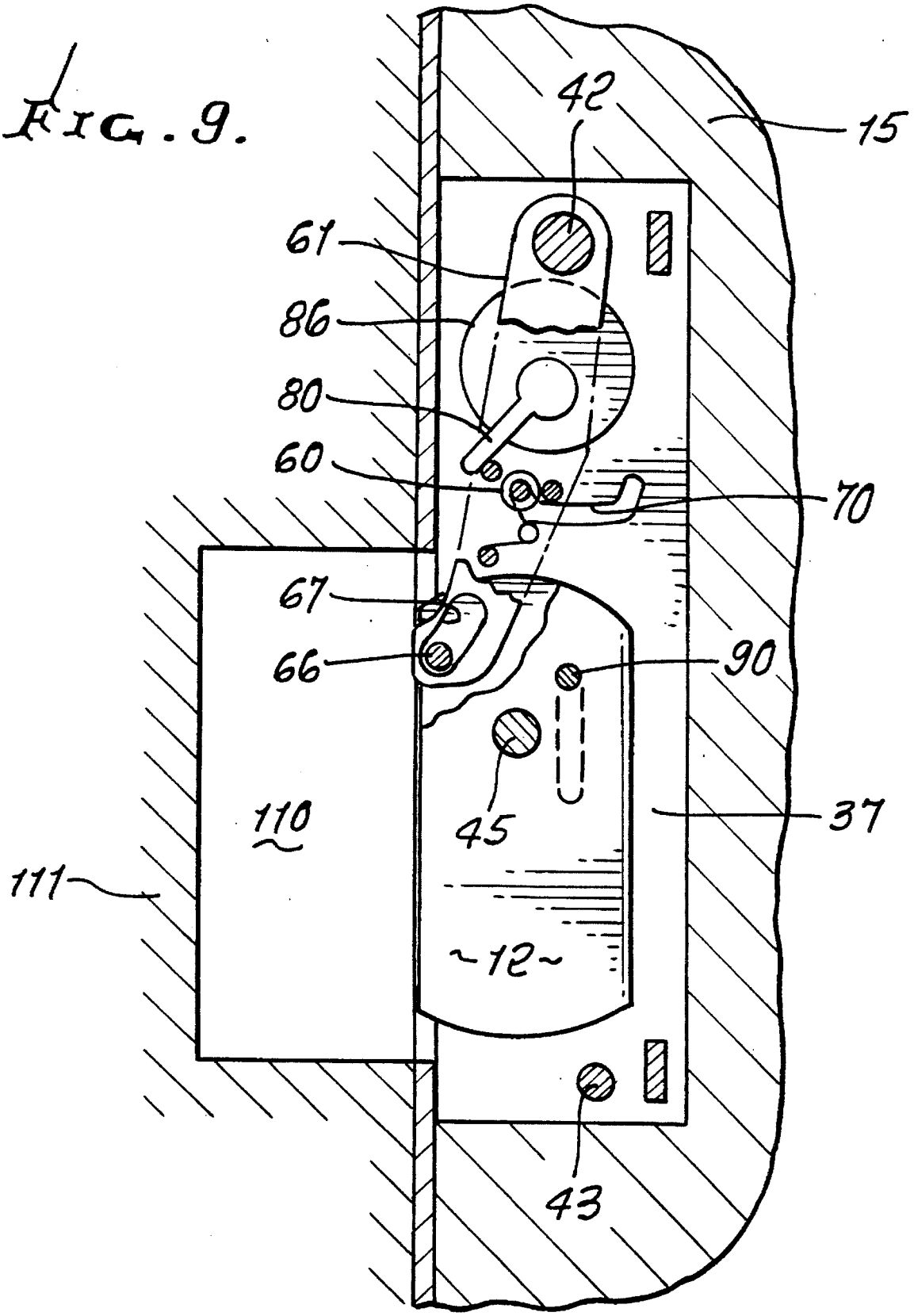
FIG. 9 is a view like FIG. 8 but showing the bolt in unlatching position.

7 and FIG. 9 position. Such crank-type handle movement can be made easily by downward movement in the direction of force arrow F in FIG. 1, as via a walking cane as may be utilized by a disabled person, allowing that person to then quickly open the door 15 and exit from a room interior 16.

The invention also enables a person at the outer side 17 of the door to insert a key 18 into the apparatus and rotate the key to cause the bolt to rotate from latching to unlatching position.

Extending the description to FIGS. 3, 6, 7, and 10, the assembly includes a rotor shown in the form of a plug 20 associated with the carrier 11, and rotatable relative to the carrier, the rotor operatively connected with the handle to be rotated in response to handle rotation, as described. The axis of rotor rotation is shown at 21 and is parallel to axis 14. Two cams 54 and 55 are carried by the rotor to be rotatable therewith, and to pivot relative thereto. Also, structure is provided to be operatively connected with the bolt and located to be displaced by one cam in response to rotation of the rotor in one direction for rotating the bolt to unlocking position, and to be displaced by the other cam in response to rotation of the rotor in the opposite direction for rotating the bolt to door locking position.

Figure 3:
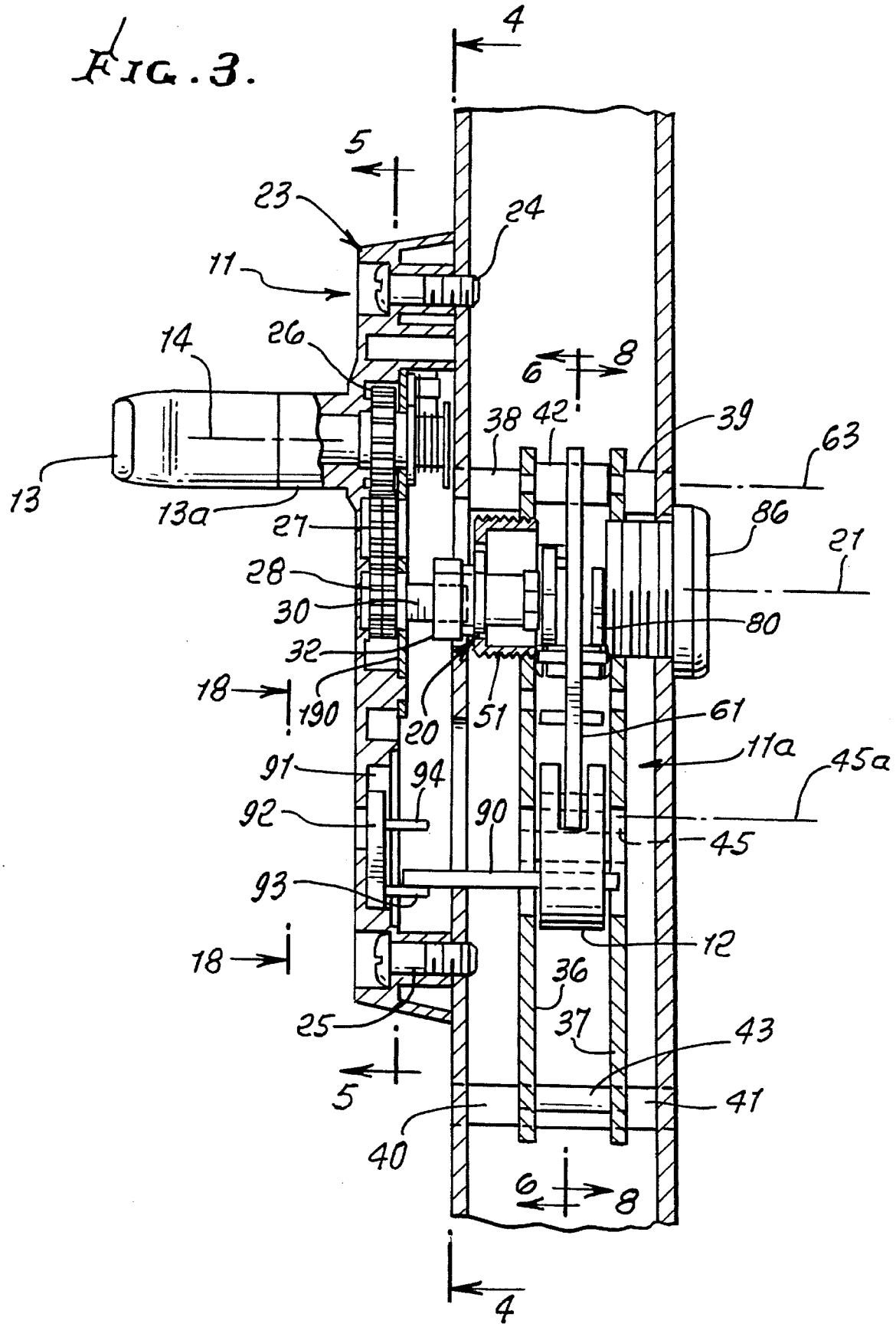
FIG. 3 is an elevation taken in section on lines 3—3 of FIG. 2.
Figure 4:
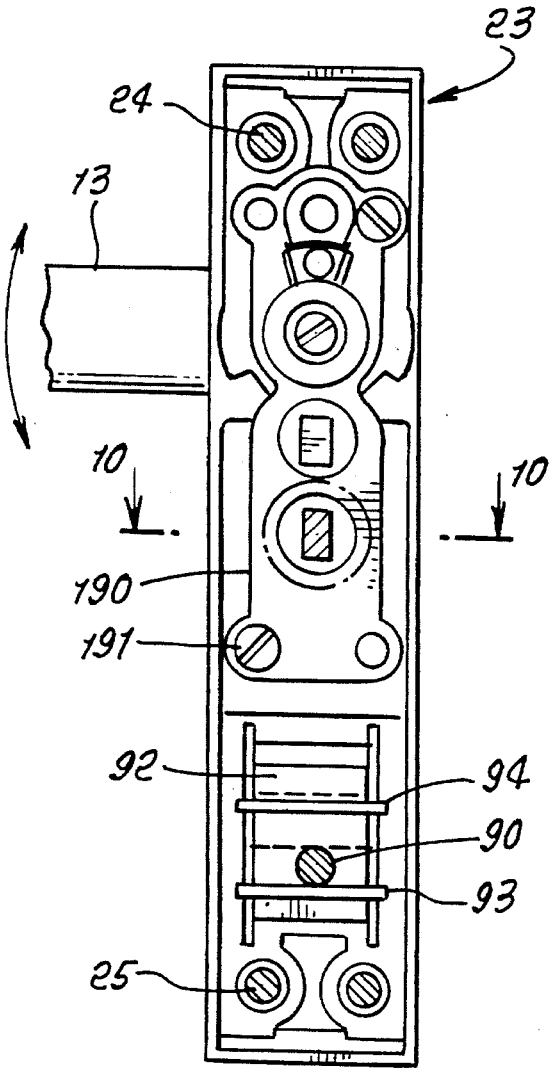
FIG. 4 is an elevation taken in section on lines 4—4 of FIG. 3.
Figure 5:
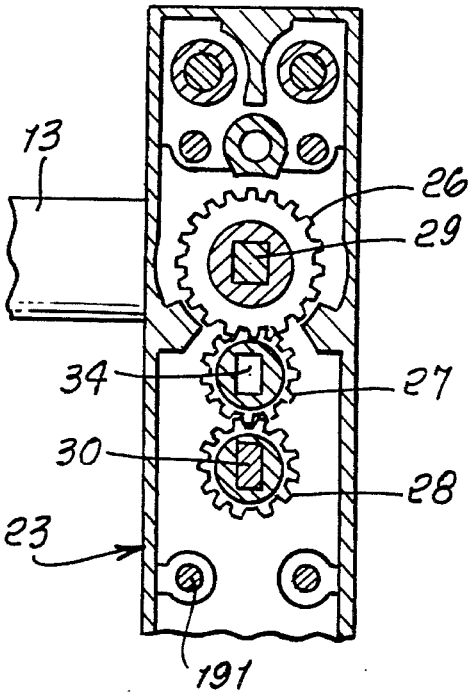
FIG. 5 is an elevation taken in section on lines 5—5 of FIG. 3.

In this regard, the carrier 11 may include a housing 23 at the door interior and attached thereto by fasteners shown at 24 and 25 in FIG. 3. Housing 23 has an edge 23*a* proximate the door edge 15*a*. Spur gears 26–28, located within the housing, transmit handle lever rotation from shaft 29 (connected to 13*a*) to shaft or arm 30 connected via axially adjustable connection 31 to plug extension or arm 32. The latter is attached by fasteners 33 to rotor or plug 20. Shaft 34 supports idler gear 27. Suitable bearings for the shafts are supported by the housing. Carrier 11 may be considered to include a sub-carrier 11*a* within the door itself, and including parallel carrier plates 36 and 37 attached to the door, as via fasteners at 38–41. See also spacers at 42 and 43. A retainer plate 190 is attached at 191 to the housing.

Bolt 12 is pivotally supported at 45 to the plates 36 and 37.

DETAILED DESCRIPTION

Figure 10:
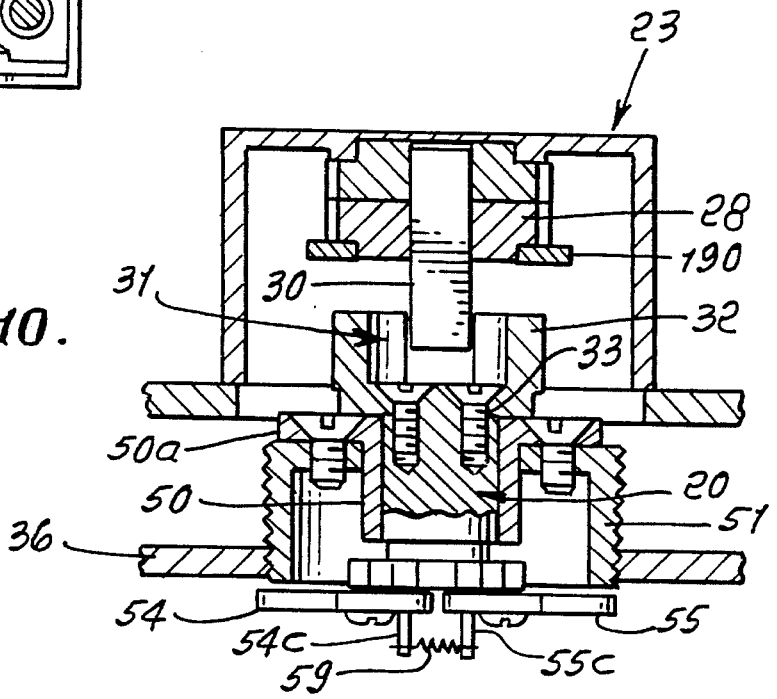
FIG. 10 is a horizontal section taken on lines 10—10 of FIG. 4.

Referring to FIG. 10, the rotor 20 is rotatable within a sleeve 50 having a flange 50*a*. The latter is attached to a plug housing 51 that is in turn attached at 52 to plate 36.

Figure 6:
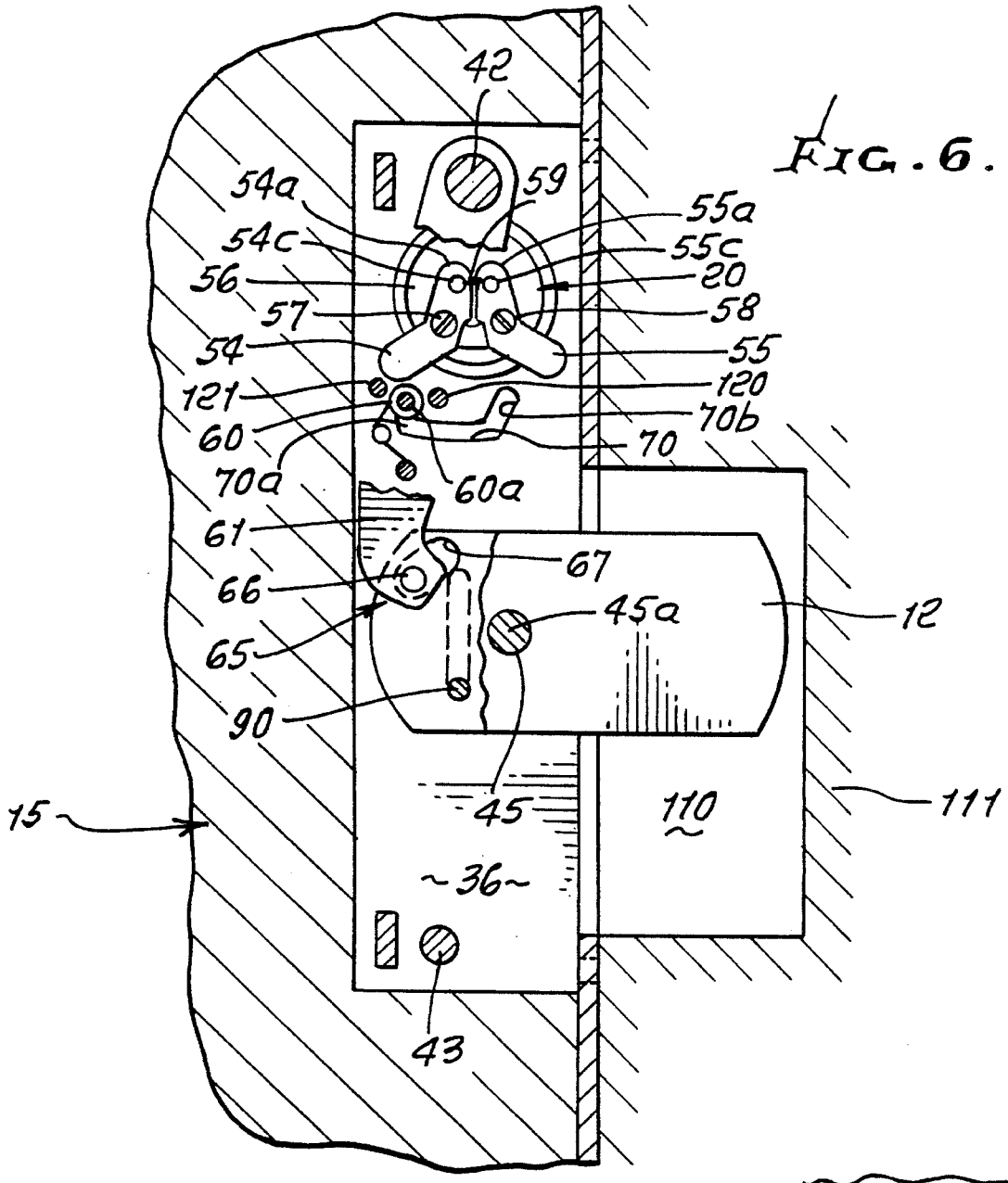
FIG. 6 is an elevation taken in section on lines 6—6 of FIG. 3 and showing a bolt in door latching position.

The rotor 56 carries two cams 54 and 55 adjacent its end face, as seen in FIG. 6. The two cams pivot on pins 57 and 58 carried by the rotor; and they have end portions 54*a* and 55*a* that project generally away from 54 and 55 and are urged toward one another by a spring 59 connected to pins 54*c* and 55*c*. Thus, the cams may relatively pivot but are urged toward positions as seen in FIG. 6. A suitable stop pin carried by the rotor is engageable by the cam, as shown, to limit clockwise rotation of cam 54, and to limit counterclockwise rotation of cam 55.

Figure 7:
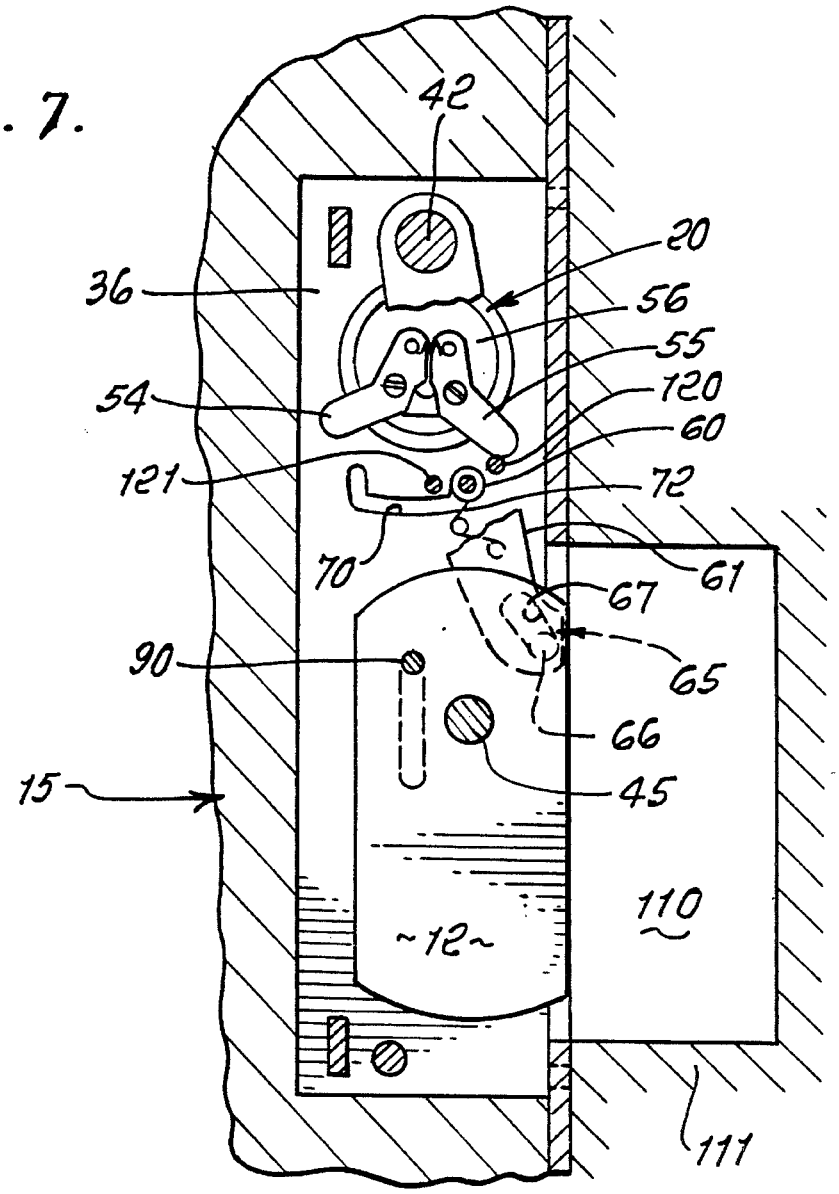
FIG. 7 is a view like FIG. 6 but showing the bolt in rotated, unlatching position.
Figure 16:
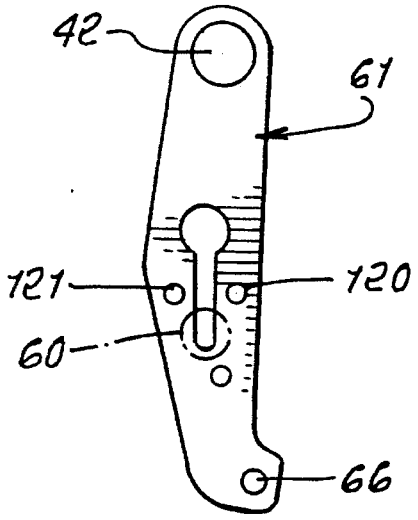
FIG. 16 is a side elevation of the bolt actuating arm.
Figure 17:
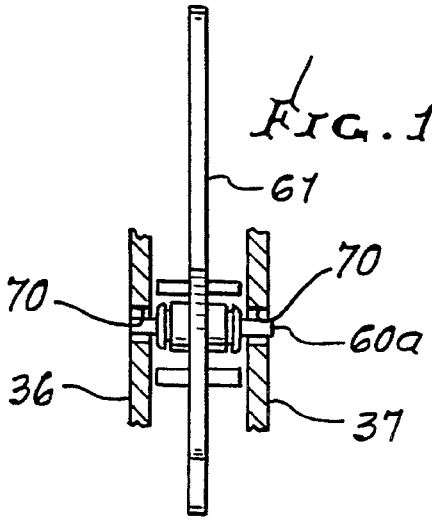
FIG. 17 is a fragmentary section showing carriage by the actuator arm of a cam follower in relation to slots in side plates.

A cam follower 60 is carried by an actuator arm 61 to project in the path of rotation of the spaced cams 54 and 55. Arm 61 upper end is pivoted from 42 to swing about an axis 63 parallel to axes 14 and 21. The lower end of the arm 61 has a lost motion connection at 65 to the bolt, as seen in FIGS. 6–8. A pin 66 on the arm lower end is received in a slot 67 in the bolt, spaced from bolt axis of rotation 45*a* provided by pivot 45.

When arm 61 is swung clockwise from FIG. 8 position, pin 66 moves in wide slot 67 to engage slot end shoulder 69, which then rotates the bolt to FIG. 9 locking position. Such arm movement is effected by cam 54 rotation (by rotor 56) to displace the follower from FIG. 8 to FIG. 9 position, i.e., corresponding to movement from FIG. 6 to FIG. 7 position. At the same time, the follower guide pin 60*a* moves in guide slots 70 in plates 36 and 37, from slot angled end portions 70*a* to slot angled end portions 70*a*. In each of these camming angled end portions, the pin 60*a* tends to be frictionally held in position at one or the other of the extremes of arm 61 swing, corresponding to both FIG. 7 and FIG. 8 positions, thereby holding arm 61 in position at the end of its swinging movement. This holds the bolt in FIG. 6 or FIG. 7 position.

Arm 61 movement in the opposite direction is effected by cam 55 rotation (by rotor 56) to displace the follower from FIG. 9 position to FIG. 8 position (i.e., corresponding to movement from FIG. 7 to FIG. 6 position). A spring 72 carried by the arm 61 and engaging the follower is tensioned as the follower moves into each of the angled slot end portions, to assist in the arm retention function.

Referring to FIG. 6, as cam 54 is rotated counterclockwise by the rotor, it first displaces follower 60 downwardly, as described, and then the cam engages a pin 120 on the arm 61, thereby to rotate arm 61 counterclockwise toward the arm position in FIG. 7. The rotor then returns to FIG. 7 position.

Likewise, and referring to FIG. 7, as cam 55 is rotated clockwise by the rotor, it first displaces follower 60 downwardly, as described, and then the cam engages a pin 121 on arm 61, thereby to rotate arm 61 clockwise toward its position in FIG. 6. The rotor then returns to FIG. 6 position.

As referred to above, the arm has lost-motion connection to the bolt, allowing the bolt to be rotated only after the arm has been rotated to predetermined extent. Such predetermined extents of arm rotation act to move the follower pins 60*a* out of one or the other of the slot 70 turned ends, before rotation of the bolt is effected, due to the functioning of the lost motion connection, thereby easing locking and unlocking action.

A separate lock arm 80, operated, i.e., rotated by the key 18, also engages the follower at the opposite side of the arm 61 (see FIGS. 3 and 8) to swing the actuator arm 61 in the manner described. Thus, the bolt can be latched and unlatched by rotation of either the lever handle 13 or the key 18; and the invention makes possible the integration of operation of a bolt by either rotation of a lever handle at one side of a door, or by rotation of an inserted key at the opposite side of the door. The key receptacle is designated at 86.

Figure 18:
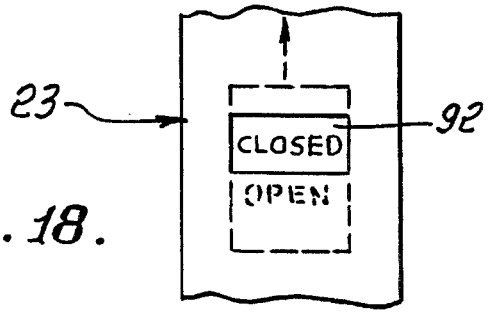
FIG. 18 is an elevation taken on lines 18—18 of FIG. 3.

An indicator rod 90, carried by the bolt, projects laterally in FIG. 3 into an indicator zone 91 formed by the housing 23. An indicator slide 92 is shifted up by the rod 90 when the arm 61 is swung in one direction, and down when the arm is swung in the opposite direction. See also FIG. 18. Shoulders 93 and 94 on the slider are engageable by the rod, as the arm rotates.

A recess 110 in wall 111 receives the bolt 12, as shown in FIGS. 2 and 6.

I claim:

1. In a door latching and unlatching assembly, the combination comprising:

a) a carrier, b) a door latching bolt carried by the carrier to rotate between locking and unlocking positions, c) a door latching operating handle rotatable between open and closed positions, d) a rotor associated with and rotatable relative to the carrier, and first and second cams on the rotor and rotatable therewith, the rotor operatively connected with the handle, to be rotated in response to handle rotation, e) and a structure operatively connected with the bolt and located to be displaced by said first cam in response to rotation of the rotor in a first rotary direction for rotating the bolt to unlocking position, and to be displaced by said second cam in response to rotation of the rotor in a second rotary direction which is opposite said first rotary direction, for rotating the bolt to door locking position, f) said first cam having pivoted connection to the rotor at a first pivot location, whereby said first cam pivots relative to the second cam, to decouple from said structure upon return rotation of the rotor in said second rotary direction to an initial position after opening of the bolt, g) said second cam having a pivoted connection to the rotor at a second pivot location, whereby said second cam pivots relative to said first cam, to decouple from said structure upon return rotation of the rotor in said first direction to said initial position after closing of the bolt, h) said first and second pivot locations being spaced apart, and there being a spring structure urging the first and second cams to rotate toward positions from which said first and second cams pivot to decouple said structure, as aforesaid.

2. The combination of claim 1 including spring structure yieldably urging said first and second cams to pivot toward initial positions on the rotor.

3. The combination of claim 1 wherein said structure includes a follower positioned to be displaced in said first direction by said first cam, and to be displaced by said second cam in said second direction.

4. The combination of claim 1 wherein the carrier includes a housing having an edge to be located proximate an edge of the door, the handle comprising a lever which, in said open and closed positions, is spaced at one side of said housing edge.

5. The combination of claim 4 wherein said lever has a neutral position in which the lever extends substantially horizontally to be impacted downwardly, and wherein, in said bolt unlocking position, the lever has been rotated downwardly relative to said neutral position.

6. The combination of claim 3 wherein said structure includes a rotatable arm carrying said follower.

7. The combination of claim 6 wherein said handle has a first axis of rotation, said rotor has a second axis of rotation, said rotatable arm has a third axis of rotation, and said bolt has a fourth axis of rotation, said first, second, third, and fourth axes being parallel.

8. The combination of claim 6 including said door having interior space, said rotor, first and second cams, and rotatable arm located in said space, said handle located outside said interior space at one side of the door, and there being gear structure outside said interior space coupling the handle to said rotor.

9. The combination of claim 6 wherein said rotatable arm has lost motion connecting to said bolt, allowing the bolt to be rotated only after the rotatable arm has been rotated to predetermined extent.

10. The combination of claim 6 wherein the follower has a projection movable in a slot defined by non-rotary structure associated with the carrier, the slot having turned ends acting as keepers for the projection at the extremes of arm rotary excursion.

11. The combination of claim 9 wherein the follower has a projection movable in a slot defined by non-rotary structure associated with the carrier, the slot having turned ends acting as keepers for the projection at the extremes of arm rotary excursion, said predetermined extent of arm rotation acting to move the projection out of at least one of said slot turned ends.

12. The combination of claim 6 including a key receptacle carried by said structure for reception of a key, and a lock arm associated with the key receptacle and rotatable upon turning of the key to displace the follower in said directions.

13. The combination of claim 12 wherein the rotatable arm has opposite sides, and the follower has a first portion at one of said rotatable arm sides to be engaged by first and second said cams, and a second portion at the other of said rotatable arm sides to be engaged by said lock arm.

* * * * *